US005873752A

United States Patent [19]

Baskin et al.

[11] Patent Number: 5,873,752

[45] Date of Patent: Feb. 23, 1999

[54] TOW SOCKET CONNECTOR HAVING SEALANT

[75] Inventors: Gennady Baskin, Sharon; David R. Cummings, South Weymouth; Kayvan Hedayat, Chestnut Hill, all of Mass.

[73] Assignee: Joseph Pollak Corporation, Boston, Mass.

[21] Appl. No.: 986,582

[22] Filed: Dec. 8, 1997

[51] Int. Cl.[6] ..... H01R 13/432

[52] U.S. Cl. ..... 439/747; 439/936

[58] Field of Search ..... 439/936, 736, 439/587, 747, 733.1, 869

[56] References Cited

U.S. PATENT DOCUMENTS

| | | | |
|---|---|---|---|
| 4,422,711 | 12/1983 | Wolowicz | 439/936 |
| 4,486,067 | 12/1984 | Wallner et al. | 439/736 |
| 4,946,390 | 8/1990 | Smyers | 439/736 |
| 4,971,579 | 11/1990 | Mobley et al. | 439/595 |
| 5,009,615 | 4/1991 | Mobley et al. | 439/595 |
| 5,101,318 | 3/1992 | Fife | 439/736 |

*Primary Examiner*—Edgar Burr
*Assistant Examiner*—Leslie Grohusky
*Attorney, Agent, or Firm*—Kenway & Crowley

[57] ABSTRACT

A tow socket connector for receiving a plug from a towed vehicle and having multiple electrical terminals sealed axially through the socket from one side to the other. Each terminal is locked in its associated opening in the connector by a snap member and the thickness of each terminal is expanded by jogs formed along a portion of its length to provide a slide fit and a sealant block between the terminal and its opening. Each terminal includes a horizontal opening to permit the flow of sealant in a well formed at the upper end of the socket.

8 Claims, 4 Drawing Sheets

TOW SOCKET CONNECTOR HAVING SEALANT

This invention relates in general to socket connector assemblies and in particular to a socket connector in which all terminals are sealed from one side of the socket to the other.

BACKGROUND OF THE INVENTION

Connector assemblies for interconnection of electrical circuits between a towing and a towed vehicle are marketed in numerous different designs. Commonly, the towing vehicle will have a plastic receptacle mounted on or adjacent the rear bumper and the towed vehicle or trailer will have a plug to fit the receptacle, usually carried by a length of cable. Multiple electrical terminals insulated one from another in both plug and receptacle are common to most designs. Such terminals are usually formed as elongated metallic elements which extend through the receptacle and the plug socket in which they may be molded in place or, in some cases, held mechanically in place. When a connector socket is exposed to the environment, as in the case of a socket mounted on the bumper or rear panel of a towing vehicle, the outer end which is designed to accept the matching plug from the towed vehicle is exposed to the elements, especially when the connector is not in use and a plug is not inserted in the socket. Penetration of the socket by contaminants or moisture can cause shorting and other electrical problems. The axial openings in the socket through which the terminal elements extend are frequently the most serious causes of leakage. Some attempts have been made to seal the terminals in the openings in which they are inserted, but difficulties have arisen because of the relatively loose fit or the difference in materials; conducting terminals usually being metallic and the body of the socket usually being of insulating plastic material of different coefficient of expansion.

The present invention has as its primary object the provision of a socket connector in which electrical terminals are securely fixed in sealed relationship to the body of the socket.

A secondary object is the weatherproofing of socket connectors.

Another object of the invention is the maintenance of the integrity of electrical circuits connected to the terminals of socket assemblies.

A further object is the provision of electrical terminals in connector sockets which have an effective thickness close to those of the socket openings in which they fit.

SUMMARY OF THE INVENTION

In general, the present invention involves the use and sealing of multiple electrical terminals axially disposed in an insulating plastic body and extending from one chamber to another in the plastic body. Adjacent their upper ends, the terminals have multiple jogs stamped in a serpentine configuration in which the sine-wave undulations effectively expand the width of the terminals to a dimension slightly less than the interior wall spacing of the openings to provide a slide-fit when the terminals are inserted. Their lower ends are formed into axially extending male contact terminals.

Each terminal also has a pair of normally deflected fingers which are momentarily compressed by the walls of the opening in the socket as they are inserted. The fingers spring back to their original deflected position when they clear a shoulder formed in a wall of the terminal opening, providing a snap-in lock of the terminal in place. In addition to the serpentine portion and the deflectable fingers, each terminal has a hole or opening formed horizontally at a point just above the serpentine portion. The hole permits the radial flow of liquid sealant through each terminal from one side of the socket to the other when the sealant is dispensed in the socket. The viscosity of the sealant and the size of the horizontal opening in the terminal are chosen to permit easy flow of the sealant by gravity to form a level surface in a well formed above the axial openings in the socket. The jogs of the serpentine configuration fit the openings tightly enough to prevent the flow of sealant to the opposite side of the connector.

For a better understanding of the present invention, together with other and further objects, features and advantages, reference should be made to the following description of a preferred embodiment which should be read with reference to the appended drawing in which:

DESCRIPTION OF PREFERRED EMBODIMENT

Figure 1:
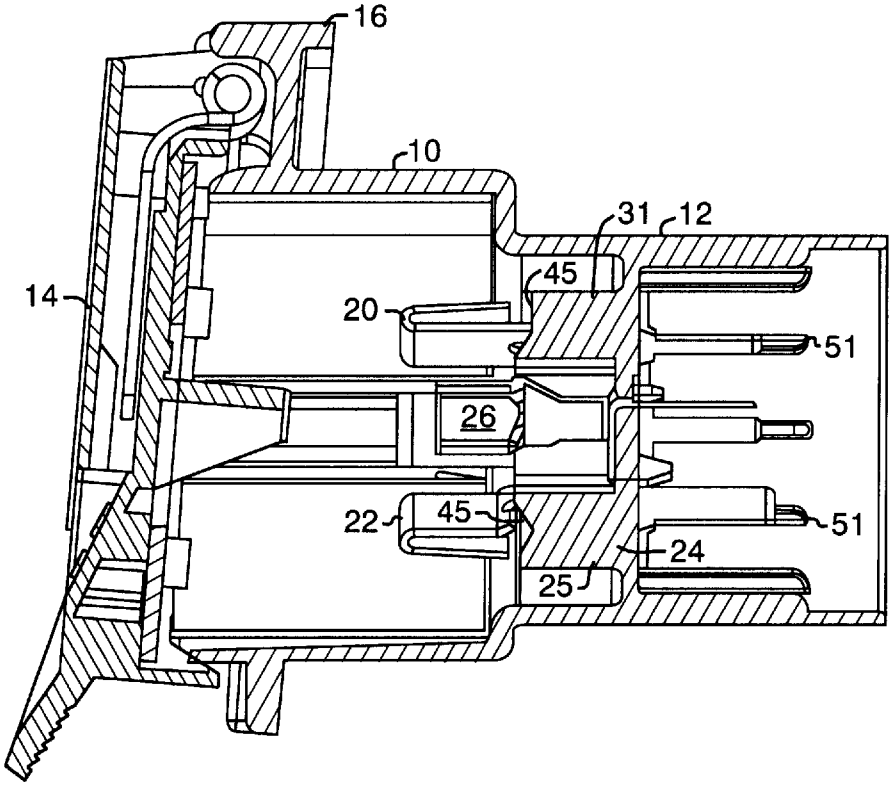
FIG. 1 is a sectional view of a connector built in accordance with the present invention.

FIG. 1 is a view in section of a tow socket connector which includes a body of generally cylindrical shape which may have a relatively large first end 10 and a smaller end 12. A weather-proofing cover 14 may be pivotally mounted on a flange 16 integral with the large first end 10. The socket and cover are made preferably of plastic insulating material such as nylon. A number of axial openings arrayed in a circular pattern are formed through a dividing partition 24 and an integral toroidal extension 31. A well 45, tapered inwardly, is formed in the upper surface of the toroidal extension to receive liquid sealant and permit it to flow and level itself by gravity.

A number of terminals also arrayed in a circle, the terminals 20 and 22 being typical, extend through the axial openings 23 and 25 formed through the toroidal extension 31 and the dividing partition 24 between the two ends of the connector body. The terminals are formed at their lower ends into male contact terminals 51.

There also may be a center terminal 26 passing axially through an opening formed centrally in the partition 24 and also ending in a contact terminal. The terminals are made of electrically conducting strip material of about 0.032" thickness, such as brass or plated copper alloy, and a typical terminal 20 is shown best in FIGS. 3 and 4.

Figure 2:
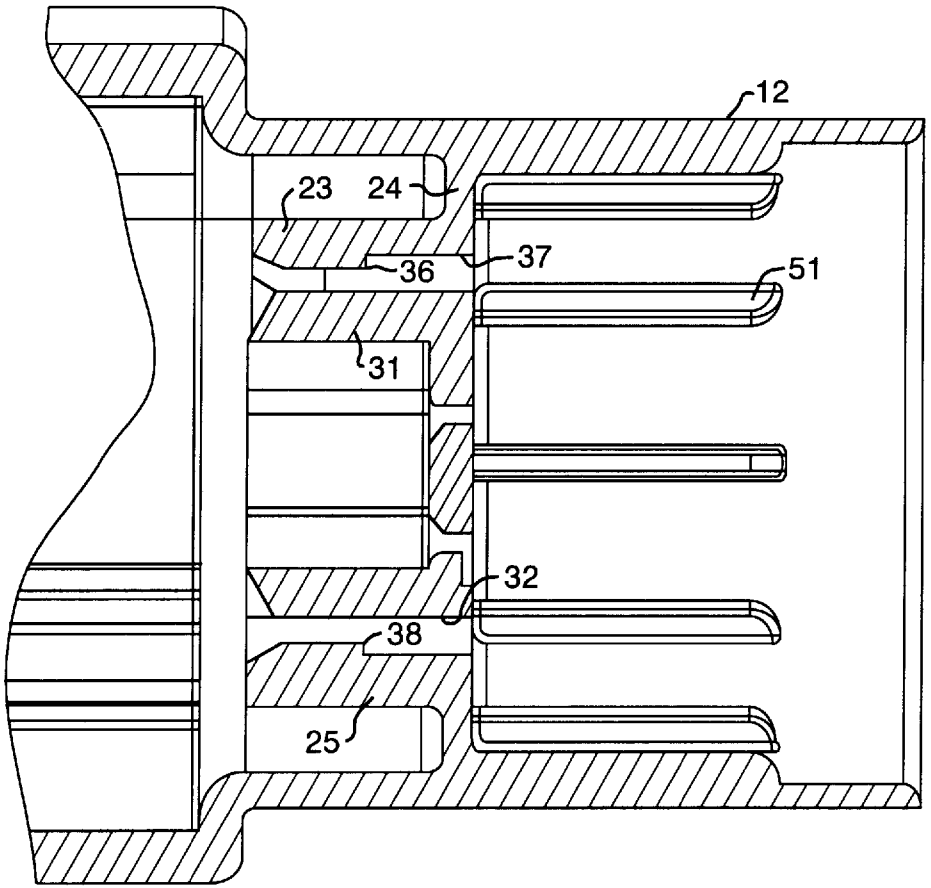
FIG. 2 is a view in elevation of an electrical terminal of the type used in the connector socket assembly of the invention.

FIG. 2 is also a view in section of the connector of FIG. 1 in which the central area is enlarged somewhat to better show features of the invention. The section is taken through an opposed pair 30 and 32 of the axial openings formed in the toroidal extension of the partition 24. Shoulders or offsets 36 and 38 are formed interiorly of the openings 30 and 32 respectively at a point which may be about mid-way through the toroidal extension of the partition 24.

Figure 3:
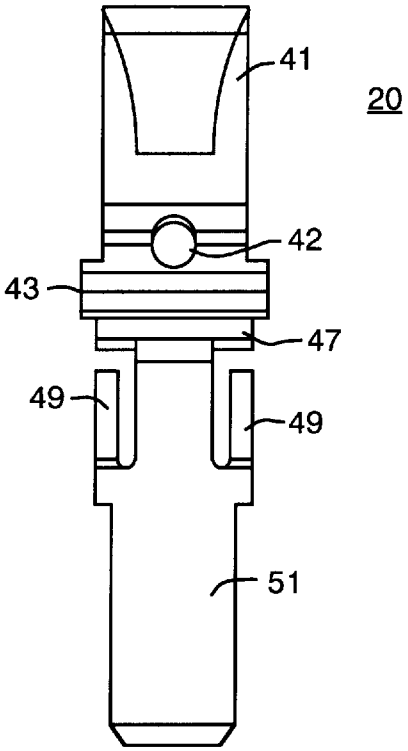
FIG. 3 is a front elevation of a terminal of the type used in the present invention.

The typical terminal 20 may be one of the array of a plurality of circularly disposed terminals, of which in this example there are six arranged in a hexagonal pattern around the periphery of the socket connector shown in FIGS. 1 and 2. FIG. 3 is a view in elevation of the terminal 20 fabricated from a metal strip the upper end 41 of which is bent back upon itself to form a resilient contact and the lower end of which is formed into a male contact terminal 51. The upper end 41 of each terminal may be tapered as shown to reduce stress upon those terminals when a plug from a trailer is inserted in the connector. A horizontal opening 42 is formed through each strip at a point adjacent the tapered well 45 countersunk in the top of the toroidal extension 31 to further facilitate the flow of liquid sealant to fill the well 45.

Immediately beneath the opening 42, serpentine jogs 47 are formed in the terminal strip by stamping. These jogs have a sine-wave configuration including internal and external radii which increase the effective thickness of each metal strip to an appropriate dimension for a relatively loose slide fit in the opening in which it is inserted. The fit is such that a liquid sealant of suitable viscosity does not flow through the opening beyond the jogs, but the minimum width of the opening is dictated by the need to accommodate a pair of deflection fingers 49 which are stamped to extend outwardly at an angle from both sides of the strip. The finger 49 normally extend to points such that they increase the effective thickness of the strip to a dimension greater than that of the opening in which the terminal strip is inserted. The width of the opening above the shoulder 36 must be great enough to permit the fingers 49 to pass through as the terminal is inserted without permanently deforming the fingers 49. Thus, when the terminal is inserted to a depth at which the fingers 47 pass beyond the shoulder 36, the fingers snap out to engage the shoulder or offset 36 and lock the terminal in place in its associated socket opening. The use of fingers at both sides of the strip increases the resilient forces and stabilizes the terminal greatly compared to conventional single finger designs.

Figure 4:
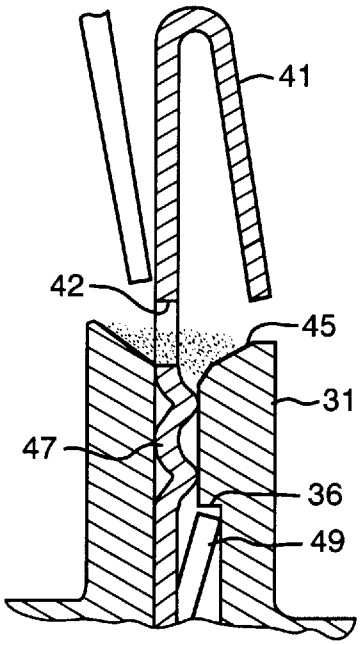
FIG. 4 is a fragmentary sectional view of a trailer connector socket in the process of manufacture.
Figure 6:
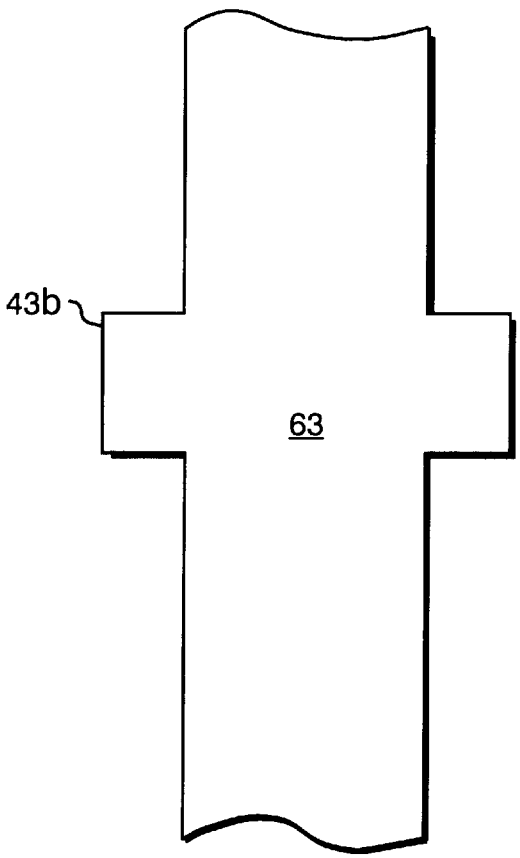
FIGS. 5 and 6 are views of alternative terminal offsets.
Figure 5:
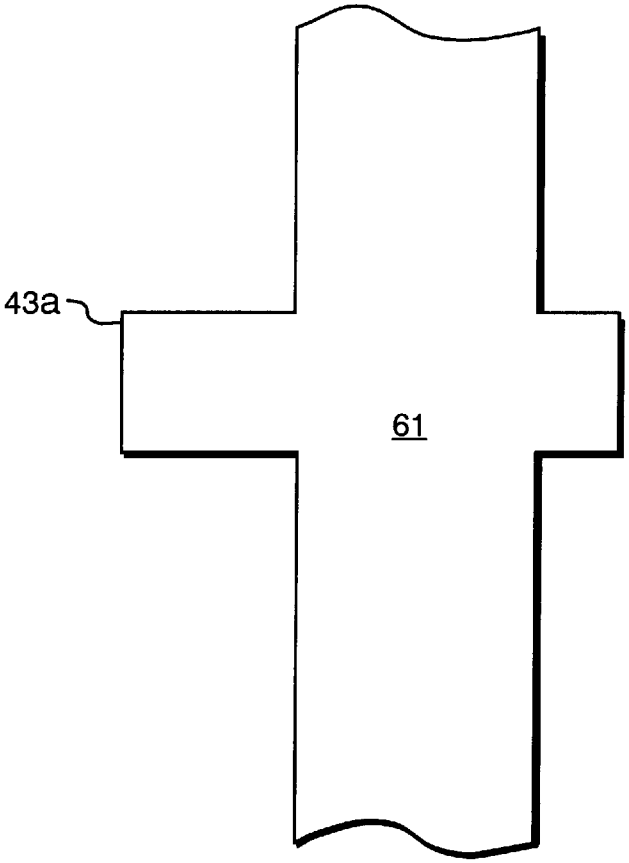

This lock-in action is apparent from examination of the fragmentary process view of FIG. 4, as also is the sealant action. After the terminals are locked in place by proper insertion, the liquid sealant material is dispensed in the well 45 of the connector body and flows by gravity through and about the terminals to set and form a solid mass with a level surface. Leakage through the partition from the outer plug receptacle of the cylindrical end 10 into the internal smaller cylindrical end 12 is substantially eliminated by jogs and the sealed opening structure. In FIGS. 5 and 6, there are shown alternative terminal strips 61 and 63. Both terminals include offset sections 43 as shown in FIG. 3. However, in terminal 61 of FIG. 5, the offset 43A is significantly longer than the offset 43B of terminal 63 shown in FIG. 6. If the terminal 61 is employed for a particular function, as for example in a low current circuit, it may be made with a larger offset in accordance with FIG. 5. All other circuits of higher current applications include terminals having a shorter offset made in accordance with FIG. 6. The axial openings 23 which accept terminals having the offset 43B as in FIG. 6 have a smaller slot than that of the single opening which accepts terminals having the larger offset 43A of FIG. 5. Thus, inadvertent connecting of a low current device to a high current circuit is avoided.

What is claimed is:

1. In a socket connector for receiving a connector plug, said socket connector having a plurality of openings having opposed walls formed axially therethrough, one of said walls in each said opening including a shoulder and a plurality of terminals disposed in said openings, the combination wherein each said terminal comprises a metal strip, said metal strip having jogs stamped therein along a portion of its length, said jogs having internal and external radiuses which increase the thickness of said metal strip to a dimension sufficiently smaller than the distance between said opposed walls to permit the insertion of said terminals in said openings in a slide fit, a length of each of said terminals below said jogs being stamped to form deflectable fingers engageable by said shoulder upon insertion of each said terminal in its associated opening, said socket connector having a tapered well formed in the upper surface thereof in communication with said openings, whereby liquid sealant being placed in said well to contact a length of each of said terminals above said jogs seals said terminals in place, said sealant being restricted in flow through said openings by said jogs.

2. In a socket connector for receiving a connector plug as defined in claim 1, the combination wherein each said length of said terminals above said jogs has an aperture formed therethrough to permit relatively free radial flow of said sealant in said well and formation of a level sealant surface.

3. In a socket connector for receiving a connector plug as defined in claim 1, the combination wherein said deflectable fingers normally expand the thickness of each of said terminals to a dimension greater than the distance between said opposed walls of said opening at points above said shoulder whereby insertion of each said terminal in its associated opening results in engagement of said deflectable fingers by said shoulder.

4. In a socket connector for receiving a connector plug as defined in claim 3, the combination wherein deflectable fingers are formed on both sides of said metal strip.

5. In a socket connector for receiving a connector plug as defined in claim 1, the combination in which the upper end of each said terminal is bent back upon itself to form a resilient contact member.

6. In a socket connector for receiving a connector plug as defined in claim 5, the combination in which each said upper end is tapered to reduce the end width of each said terminal.

7. In a socket connector for receiving a connector plug as defined in claim 1, the combination in which the lower end of each said terminal is formed into a male contact member.

8. In a socket connector as defined in claim 1, the combination wherein each of said terminals has an offset, one of said terminals having a relatively large offset and the axial opening associated with said one of said terminals has a relatively large slot to accept said relatively large offset.

* * * * *